US007722119B1

(12) United States Patent
Delmestri et al.

(10) Patent No.: US 7,722,119 B1
(45) Date of Patent: May 25, 2010

(54) CHAIR WITH A TILTABLE SEAT

(76) Inventors: Dario Delmestri, 1311 Kensington Dr., High Point, NC (US) 27262; Fabio G. Delmestri, 1416 Wales Dr., High Point, NC (US) 27262

( * ) Notice: Subject to any disclaimer, the term of this patent is extended or adjusted under 35 U.S.C. 154(b) by 51 days.

(21) Appl. No.: 11/605,791

(22) Filed: Nov. 29, 2006

(51) Int. Cl.
*A47C 1/00* (2006.01)
*A47C 7/54* (2006.01)

(52) U.S. Cl. ..... 297/313; 297/337; 297/411.42; 297/411.43; 297/DIG. 10

(58) Field of Classification Search ..... 297/312, 297/313, 411.42, 411.43, DIG. 10, 337, 311, 297/335, 326
See application file for complete search history.

(56) References Cited

U.S. PATENT DOCUMENTS

| | | | | | |
|---|---|---|---|---|---|
| 483,265 | A * | 9/1892 | Schindler | 297/313 |
| 633,087 | A * | 9/1899 | Johnson | 297/313 |
| 657,875 | A * | 9/1900 | Johnson | 297/313 |
| D101,567 | S * | 10/1936 | Vavrik | D6/375 |
| 2,529,532 | A * | 11/1950 | Abbott et. al. | 297/256 |
| 2,990,876 | A * | 7/1961 | Burbige | 297/239 |
| 3,029,108 | A * | 4/1962 | Good | 297/411.43 |
| 3,250,569 | A * | 5/1966 | Gaffney | 297/330 |
| 3,708,202 | A * | 1/1973 | Barecki et al. | 297/239 |
| 4,035,019 | A * | 7/1977 | Gabourie | 297/239 |
| 4,232,901 | A * | 11/1980 | Harrington et al. | 297/423.45 |
| 4,690,457 | A * | 9/1987 | Poncy et al. | 297/337 |
| 5,024,485 | A * | 6/1991 | Berg et al. | 297/312 |
| 5,048,893 | A * | 9/1991 | Cowan et al. | 297/329 |
| 5,056,866 | A * | 10/1991 | Tobler | 297/303.3 |
| 5,082,327 | A * | 1/1992 | Crisp | 297/313 |
| 5,180,208 | A * | 1/1993 | Lawandi | 297/440.11 |
| 6,454,285 | B1 * | 9/2002 | Koenig | 280/250.1 |
| 6,755,468 | B1 * | 6/2004 | Pan | 297/335 |
| 7,073,864 | B2 * | 7/2006 | Olsen | 297/447.1 |
| 7,147,286 | B2 * | 12/2006 | Cesaroni et al. | 297/301.1 |
| 7,275,788 | B2 * | 10/2007 | Dettmann et al. | 297/239 |
| 2006/0202529 | A1 * | 9/2006 | Johnson et al. | 297/286 |
| 2007/0252419 | A1 * | 11/2007 | Takahashi | 297/312 |

* cited by examiner

*Primary Examiner*—David Dunn
*Assistant Examiner*—Tania Abraham

(57) ABSTRACT

A chair having a tiltable seat for convenience and safety for elderly, infirm or injured users. The seat is mounted on an axle to allow the seat front edge to tilt downwardly for ingress and egress purposes and for sitting, the seat will tilt downwardly at the seat rear edge. Cantilevered ends on the chair arms assist in gripping and a footrest is attached to the legs of the chair for user convenience.

5 Claims, 10 Drawing Sheets

CHAIR WITH A TILTABLE SEAT

FIELD OF THE INVENTION

The invention herein pertains to a chair for elderly or infirm users and particularly pertains to a chair with a tiltable seat for easy ingress and egress.

DESCRIPTION OF THE PRIOR ART AND OBJECTIVES OF THE INVENTION

With the aging population increasing throughout the world, medical procedures to assist the elderly are likewise increasing. Hip, knee and other replacement surgeries are now commonplace with rehabilitation and care becoming more frequent than before. Care facilities pay particular attention to patients having such surgeries in addition to the usual assistance offered for elderly and infirm. Improvements in furniture and other equipment for such users is in great demand as accidents and injuries in hospitals, rest and care facilities must be minimized as possible.

A problem has long existed in assisting patients having mobility difficulties to transition to chairs or to other furniture from a standing position. Oftentimes two (2) care providers are needed to help a standing patient using a cane or walker into a conventional chair. Once seated the patient may lapse into an unconscious or semiconscious state and inadvertently lean forward, sometimes to the extent of toppling from the chair and causing injuries. Also, the very act of sitting can be a challenge as the torso and hips must be manipulated from a higher to a lower position. Such body manipulation is often difficult for certain patients, especially those having undergone hip or knee surgery.

Therefore, in order to provide assistance and safety for elderly, infirm or injured users the present invention was conceived and one of its objectives is to supply a chair which can be easily mounted and departed through the use of a tiltable seat.

It is another objective of the present invention to offer a chair for assisting users whereupon the height of the seat is approximately fifteen (15) centimeters greater than conventional chair seats.

It is still another objective of the present invention to provide a chair with arms having cantilevered ends for easy and secure manual gripping.

It is a further objective of the present invention to provide a chair having a convenient footrest for use while entering and exiting the chair.

It is still a further objective of the present invention to provide a chair having a frame with an axle and pillow blocks affixed to allow the seat to freely rotate as required during user ingress and egress.

Various other objectives and advantages of the present invention will become apparent to those skilled in the art as a more detailed description is set forth below.

SUMMARY OF THE INVENTION

The aforesaid and other objectives are realized by providing a chair having a rigid frame for attachment to a tiltable seat. The rigid frame is constructed of metal and includes a cylindrical axle welded thereto. Pillow blocks are affixed to the axle for rotation thereon. A seat having a rigid bottom surface is affixed to the pillow blocks above the frame and allows the seat to move similar to a see-saw. A pair of front and rear legs both having an inverted L-shape to provide for the arms of the chair are affixed to the frame on opposing ends. The arms of the rear legs extend from the chair back forwardly overtop the arms of the front legs with cantilevered ends. The rear legs are formed slightly taller than the front legs and when joined together form an inverted U-shape and provide a space therebetween for containing a small rectangular inset. The cantilevered ends and the insets allow for easy gripping of the arms by the user. The rear legs support a chair back attached thereto such as by conventional screws. A rectangularly shaped footrest is affixed to the four (4) legs, below the chair frame to further assist the user upon entering and exiting the chair and for added stability. As the chair seat is positioned approximately fifteen centimeters higher than a standard chair seat, ingress and egress can easily be accomplished by infirm or injured users from a standing position.

In use, the seat is tilted downwardly along its front where it contacts the front lateral frame member. The user can then easily sit on the front edge of the tilted seat and once seated, can utilize the footrest and the cantilevered arms to slide backwardly to the rear of the seat whereupon the user's shifting weight will tilt the seat so the rear of the seat will then descend while the front of the seat ascends. The user is then sitting in a safe, comfortable position and will not topple forwardly. When the user decides to depart the chair he can easily grip the cantilevered ends of the arms with his hands and again utilizing the footrest can pull himself forward while his shifting body weight along the seat tilts the front edge of the seat downwardly allowing easy egress. Once at the front edge of the seat the user can then stand upright and depart the chair.

DETAILED DESCRIPTION OF THE PREFERRED EMBODIMENT AND OPERATION OF THE INVENTION

Figure 1:
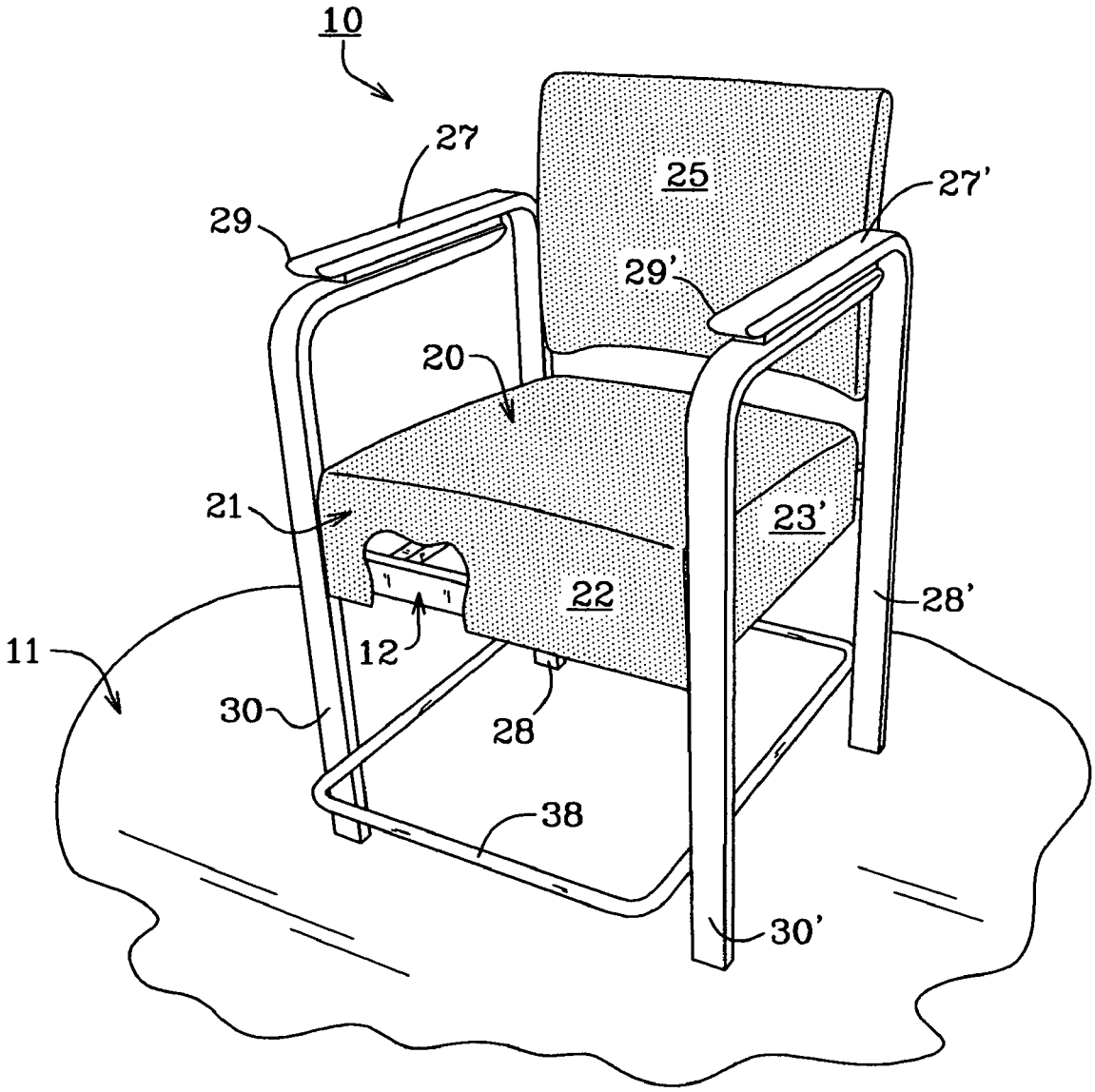
FIG. 1 shows a front, top, right side perspective view of the invention with the seat skirt partially cutaway to expose the frame therebeneath.
Figure 5:
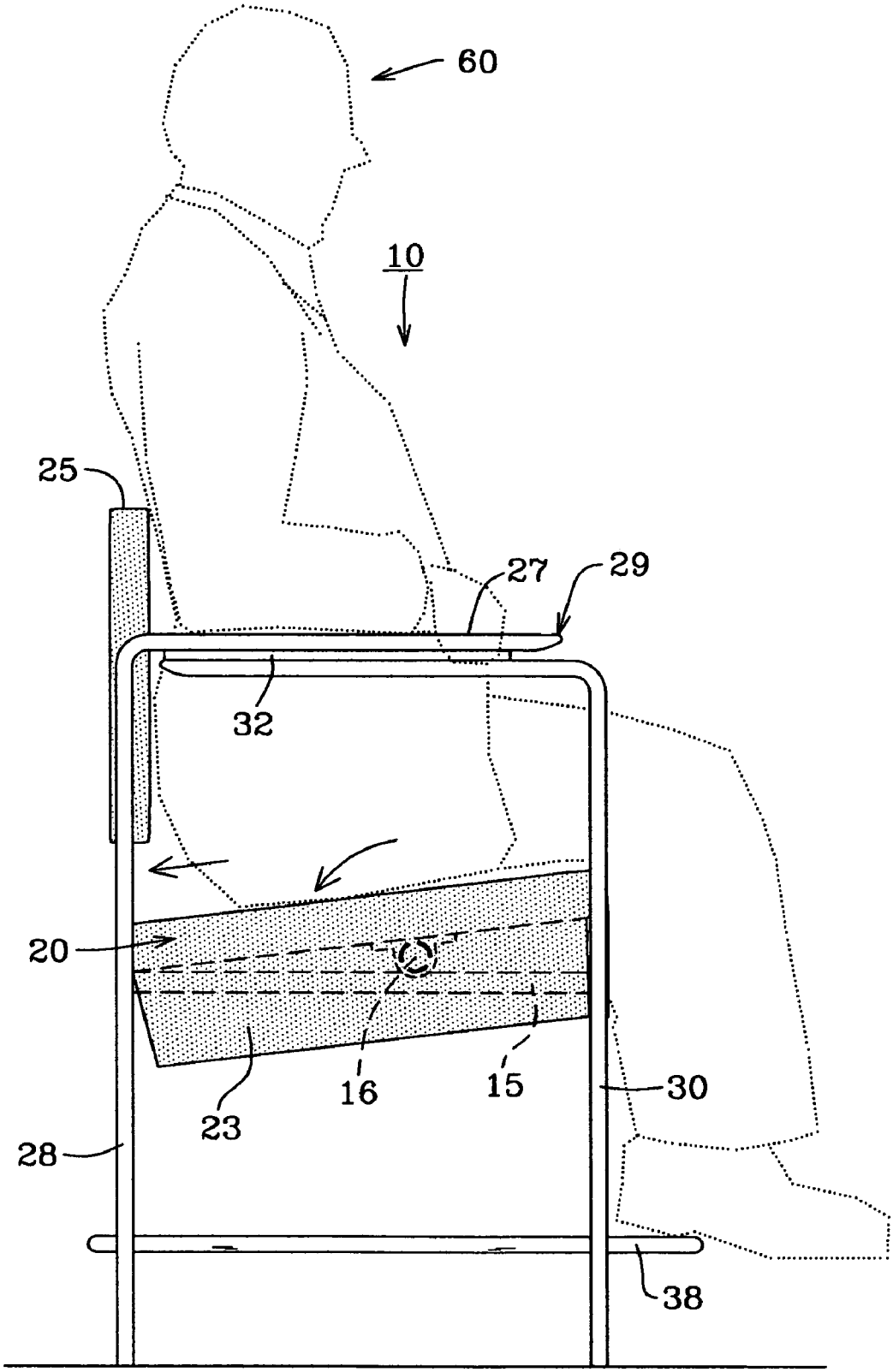
FIG. 5 illustrates a left side elevational view of the chair as shown in FIG. 4 but with the chair depicted with the seat tilted rearwardly with a user thereon as seen in dotted lines.
Figure 6:
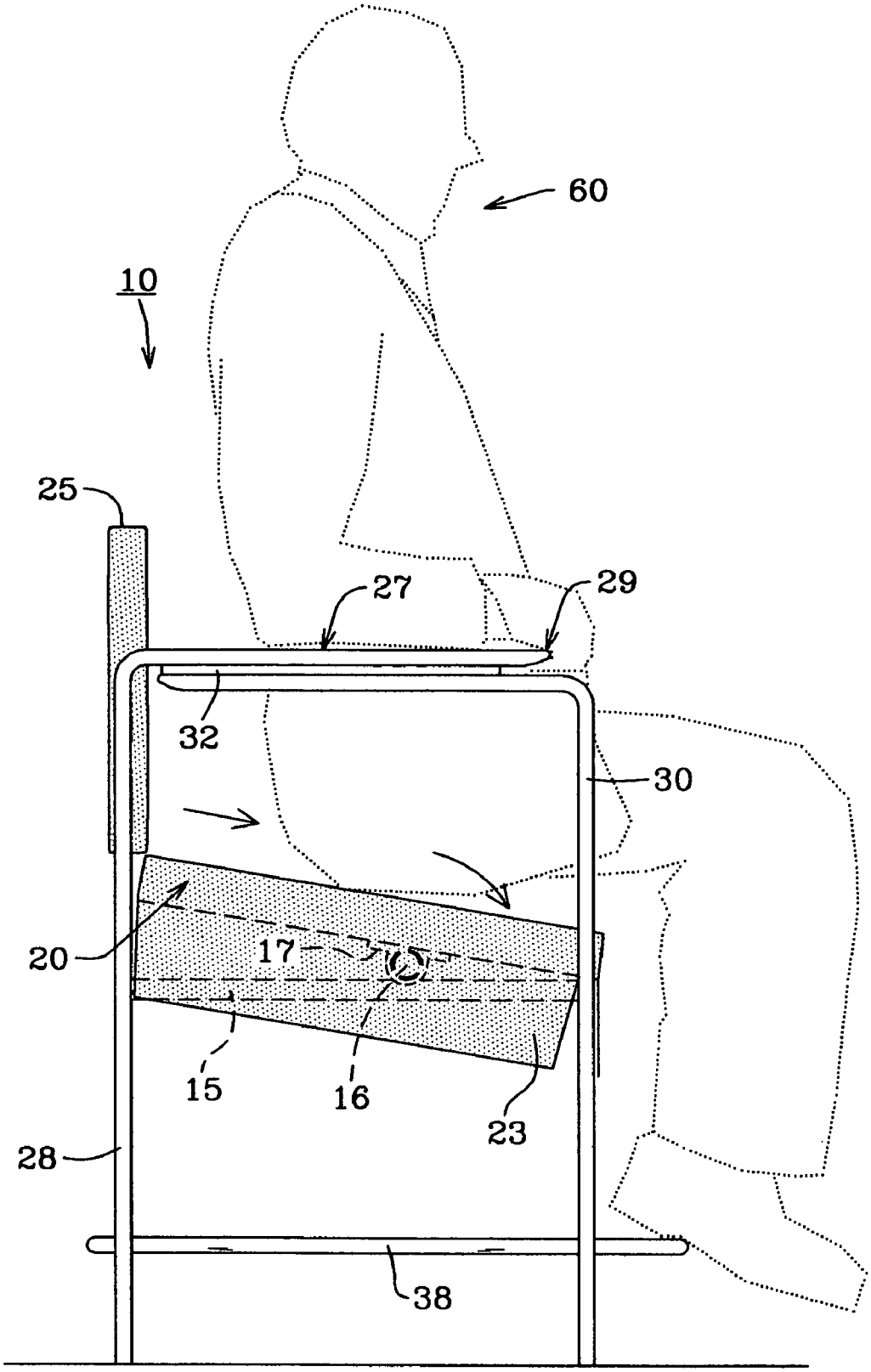
FIG. 6 depicts a left side elevational view of the chair as seen in FIG. 5 but with the chair depicted with the seat tilted forwardly with the user in an initial departing position as seen in dotted lines.
Figure 8:
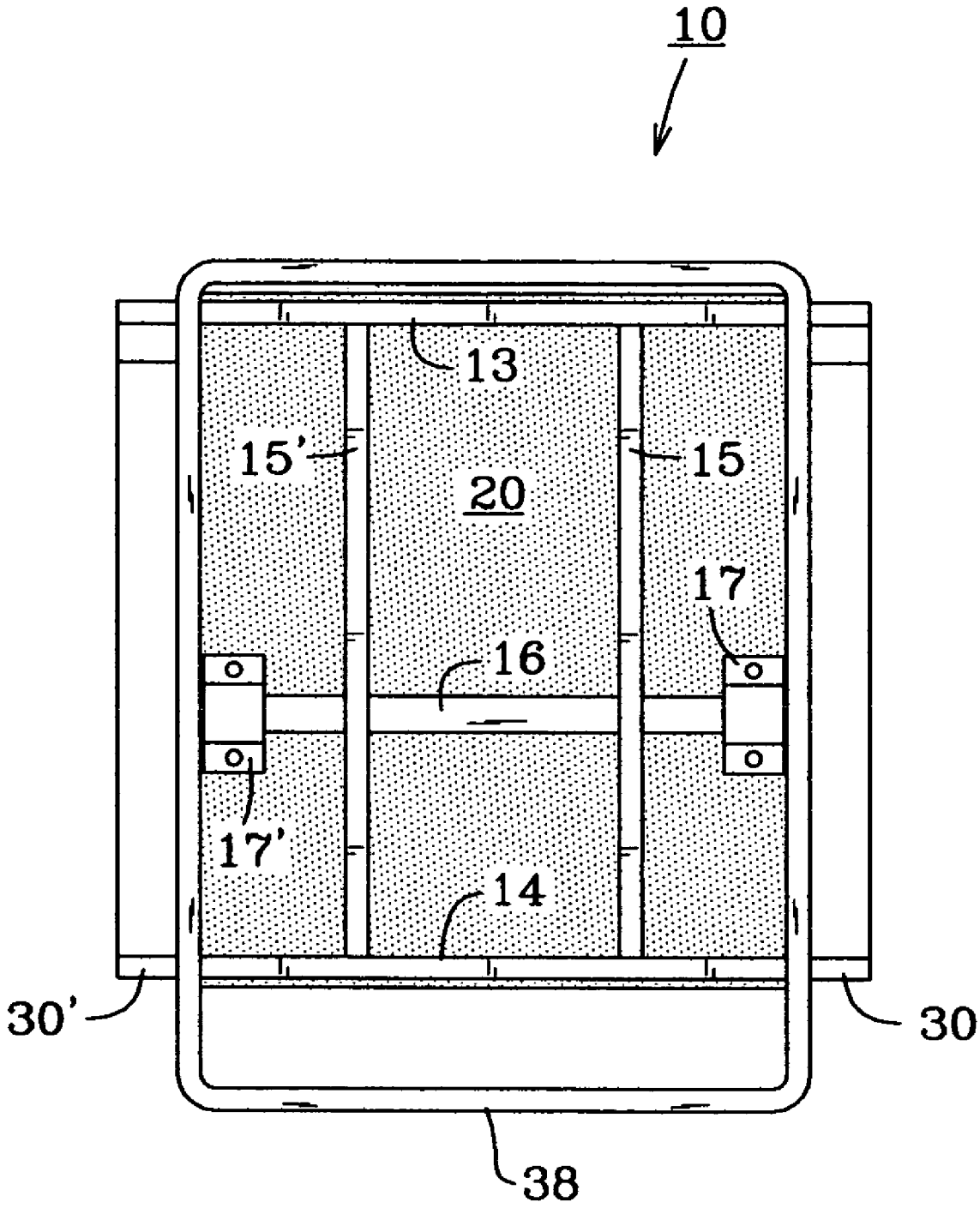
FIG. 8 shows a bottom plan view of the chair as shown in FIG. 1.
Figure 9:
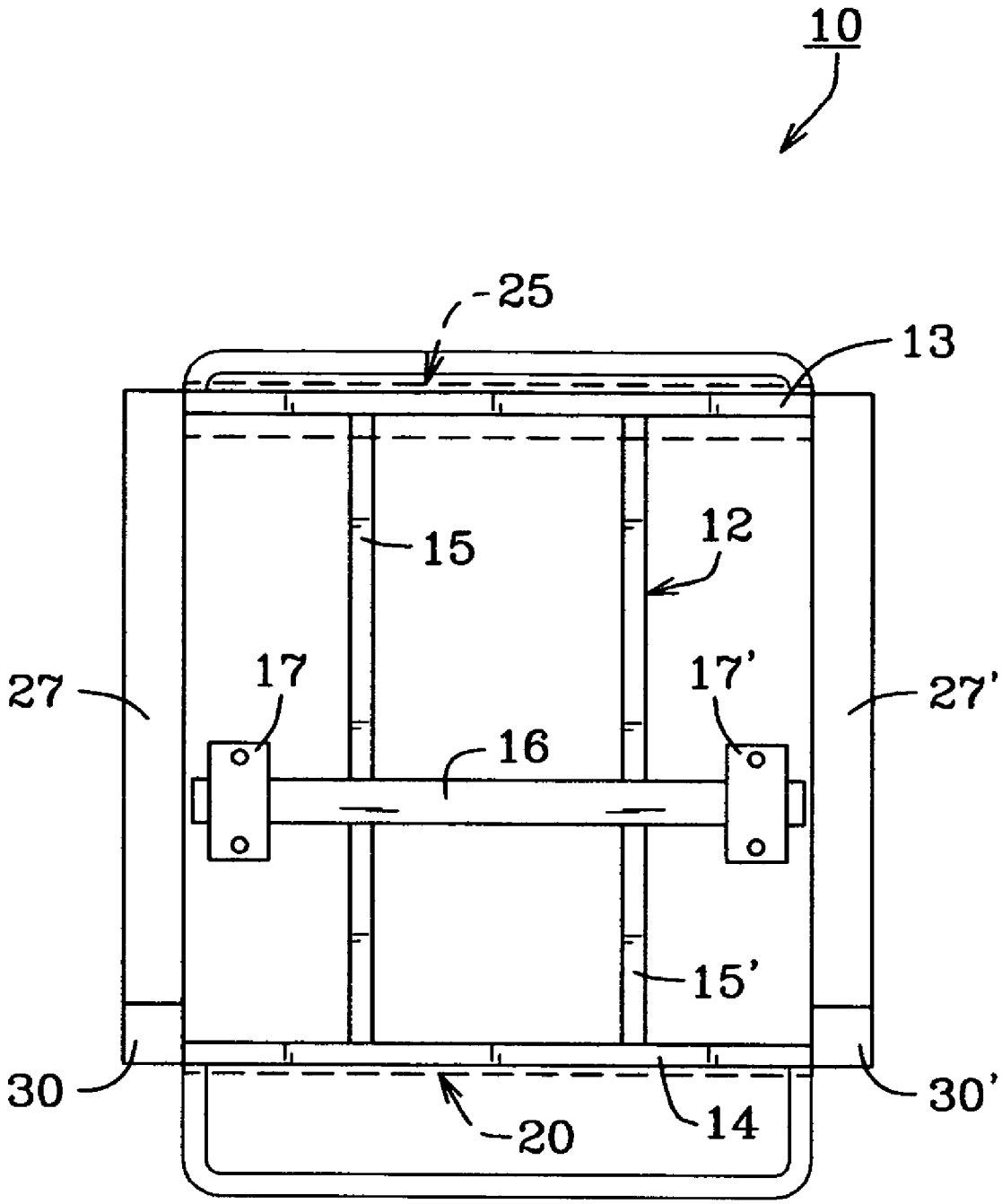
FIG. 9 demonstrates a top plan view of the chair as shown in FIG. 1 with the seat and chair back removed to expose the frame, axle and pillow blocks.
Figure 10:
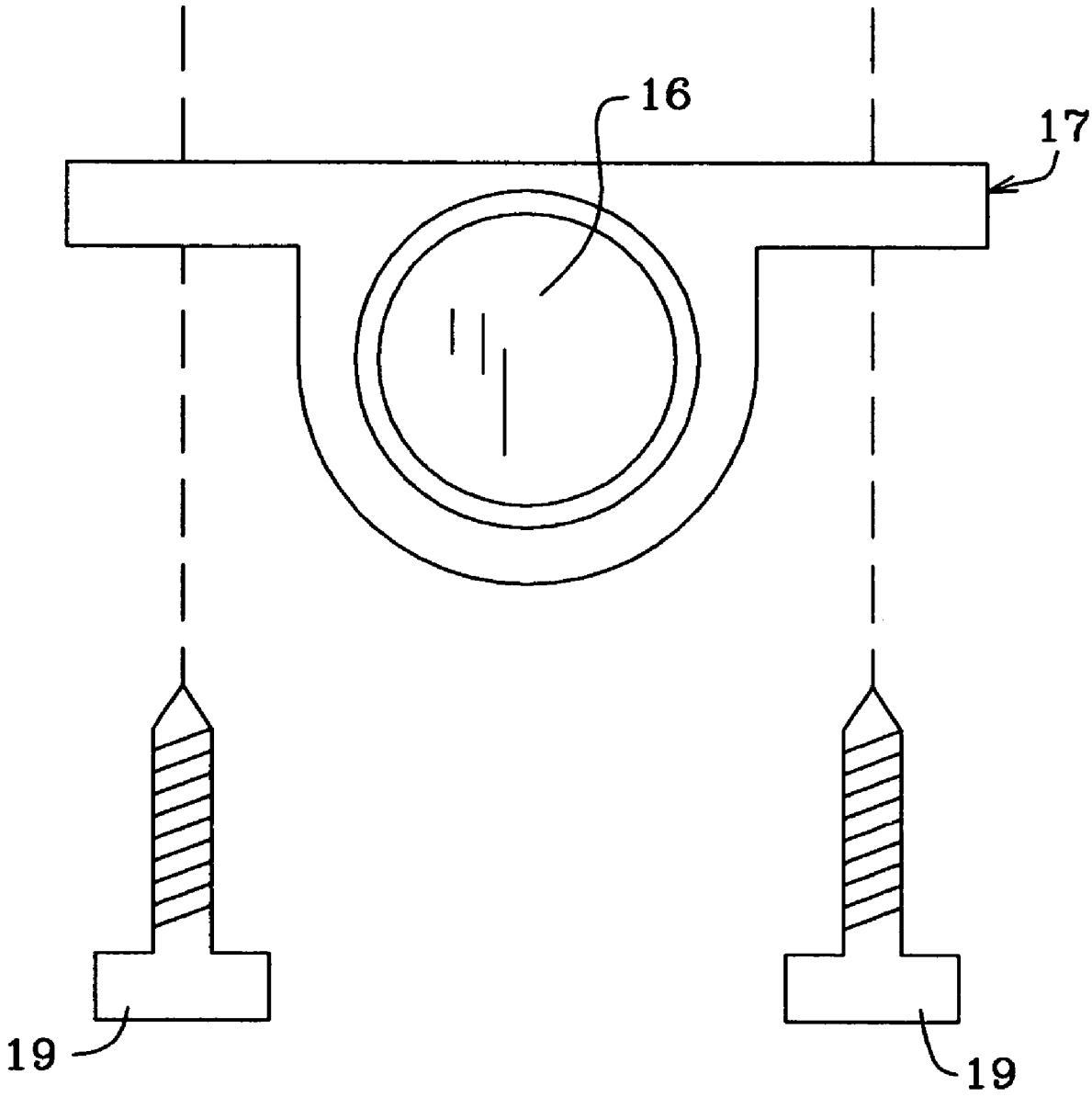
FIG. 10 illustrates an enlarged view of the pillow block affixed to the axle as removed from the frame as seen in FIG. 9.

For a better understanding of the invention and its operation, turning now to the drawings, FIG. 1 demonstrates a perspective view of preferred chair 10 positioned on floor 11 as may occur in a home, hospital, care facility or the like. Chair 10 includes a rigid metal frame 12 seen through cutaway front skirt section 22 and is affixed to front legs 30, 30' and rear legs 28, 28'. Frame 12 is shown in greater detail in a top view in FIG. 9. Frame 12 is preferably formed from steel and is chrome plated by conventional means. Frame 12 includes rear lateral member 13, front lateral member 14 and longitudinal members 15, 15' shown in FIG. 9. Rear lateral member 13 is affixed between rear legs 28, 28' and front lateral member 14 is affixed between front legs 30, 30' such as by conventional screws or bolts (not shown). Frame 12 is generally rectangular in shape with frame members 13, 14, 15, 15' preferably welded together for strength and rigidity purposes. As further shown in FIGS. 8 and 9 cylindrically shaped axle 16 is rigidly affixed to longitudinal frame members 15, 15' such as by welding for strength and durability purposes. At each end of axle 16 are pillow blocks 17, 17' which freely rotate on axle 16. In FIG. 10 an enlarged view of pillow block 17 is shown with conventional screws 19 exploded therefrom. As would be understood, screws 19 are affixed through apertures (not shown) in pillow blocks 17, 17' to the rigid bottom (not seen) of seat 20. Axle 16 is mounted forward of the center line (not shown) of longitudinal frame members 15, 15'. This forward mounting causes seat 20 to assume a normal, dormant rear tilt, as in FIG. 5. Rear lateral member 13 acts as a stop to limit the upward tilt of seat 20 while front lateral member 14 limits the downward tilt of seat 20 as seen in FIGS. 5 and 6 respectively.

Figure 4:
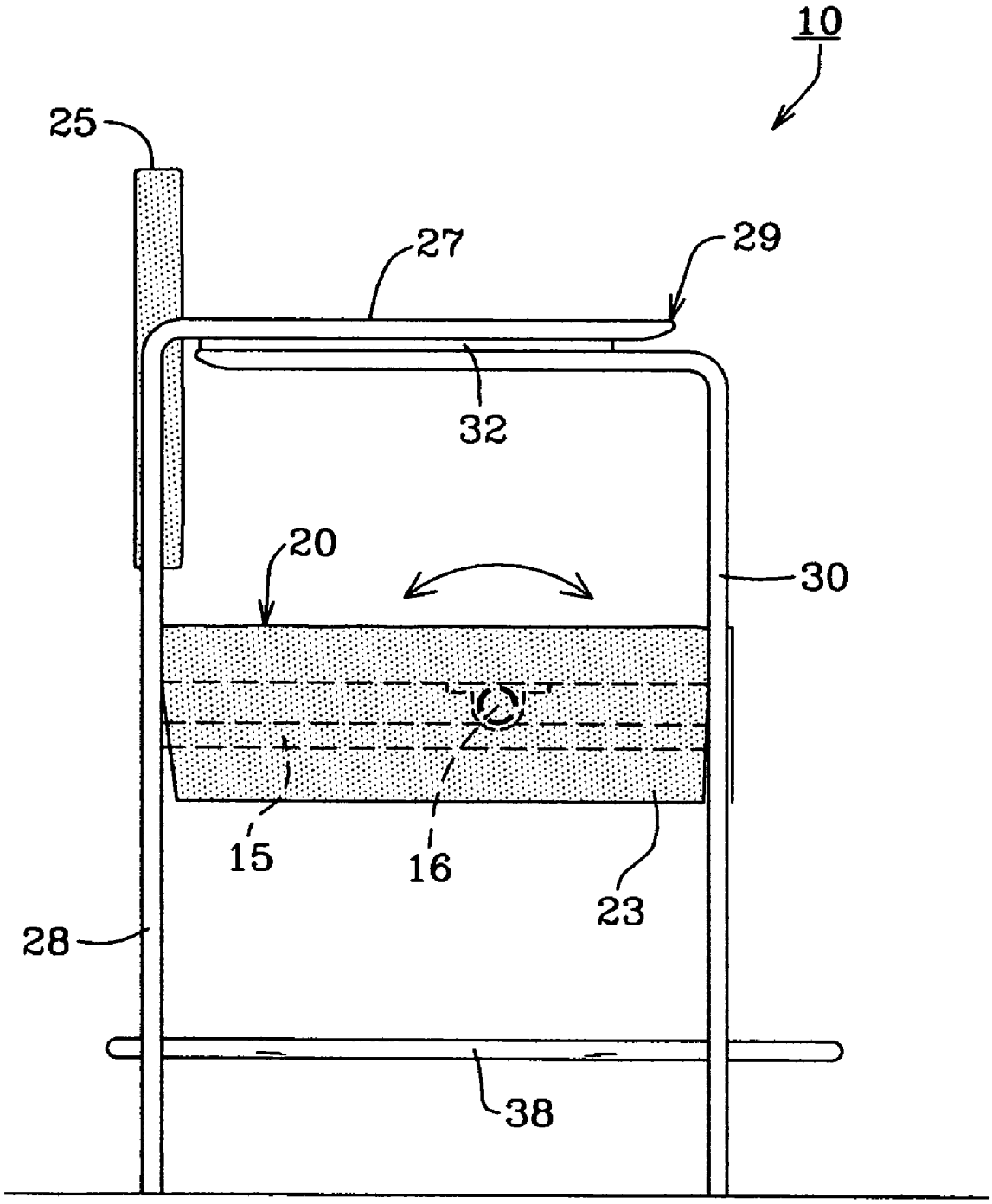
FIG. 4 depicts a left side elevational view of the chair with the frame and axle depicted in ghost fashion behind the side seat skirt.

Seat 20 is cushioned as standard and includes skirt 21 having front section 22, left side section 23 (FIG. 4) and right side section 23' as shown in FIG. 1. Skirt sections 22, 23 and 23' are attached along the top edge of seat 20 and extend downwardly to cover frame 12 to prevent finger or hand intrusion between seat 20 and seat frame 12 for safety and aesthetic reasons. Seat 20 is a typical covered, cushioned chair seat having a bottom made with a rigid plywood or other material (not seen) and is positioned higher, preferably about 15 cm, than usual chair seats which are approximately twenty inches (20") (50.8 cm) from the seat top to the floor. Chair 10 further includes covered, cushioned chair back 25 (FIG. 2) as is typical in the furniture industry. Back 25 is affixed to rear legs 28, 28' such as with standard bolts or screws (not shown) as also seen in FIGS. 1 and 4.

Figure 2:
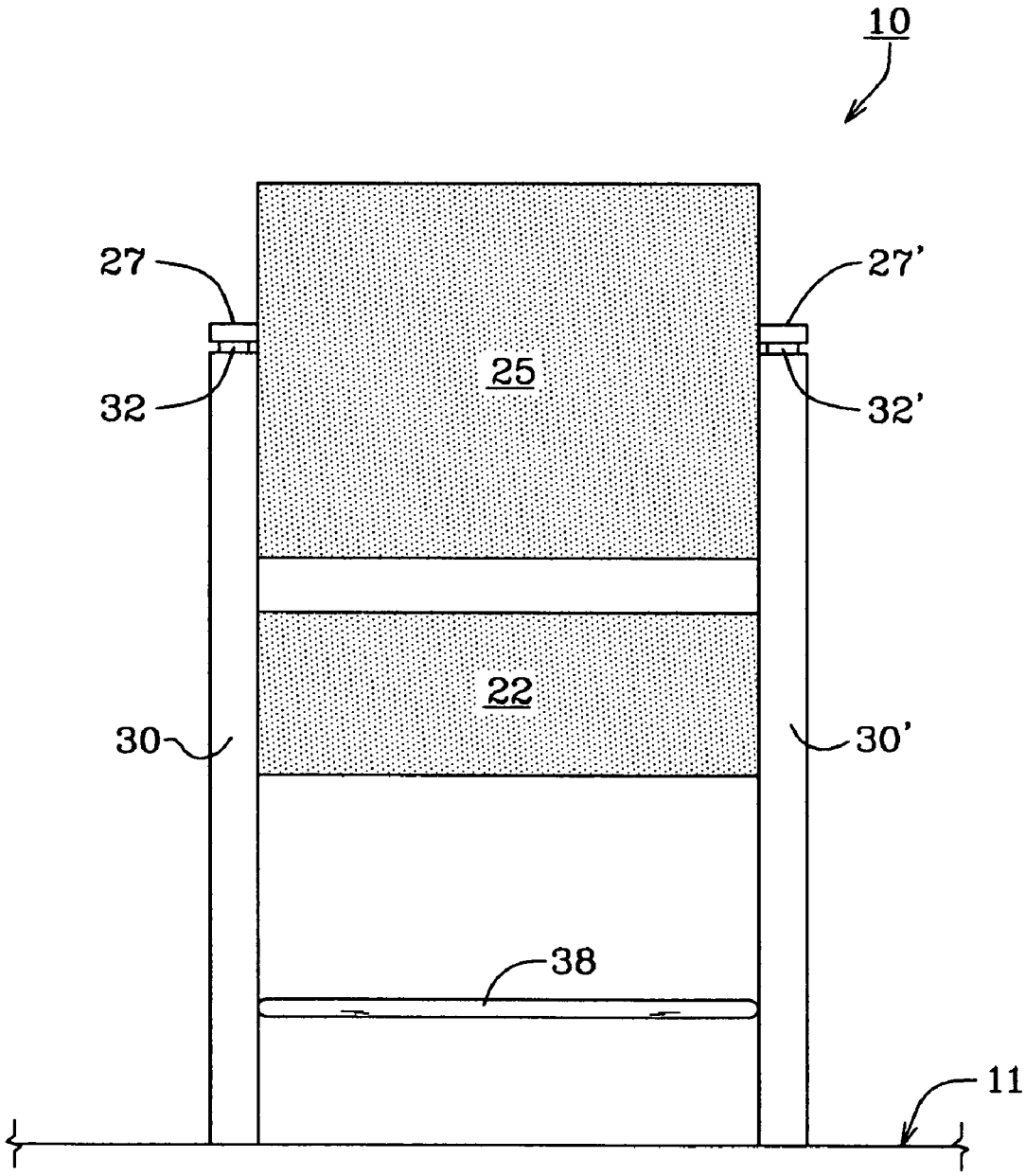
FIG. 2 is a front elevational view of the chair as shown in FIG. 1.
Figure 3:
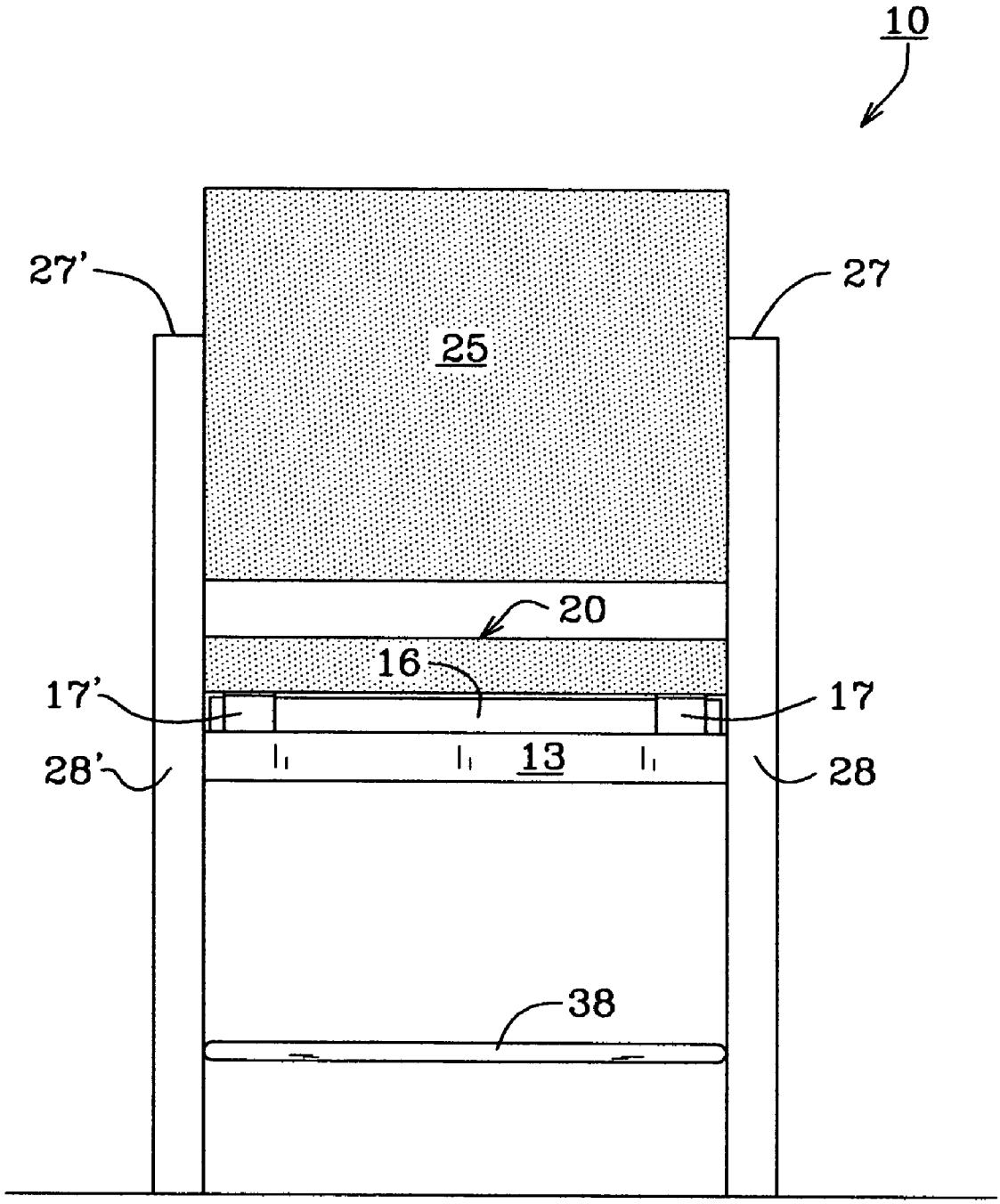
FIG. 3 shows a rear elevational view of the chair as shown in FIG. 1.

As further shown in FIGS. 1, 4, 5 and 6, rear legs 28, 28' are integrally formed in an inverted L-shape with arms 27, 27' having cantilevered forward ends 29, 29'. Front legs 30, 30' are also integrally formed in an inverted L-shape and are shorter than rear legs 28, 28' so that when joined together they form an inverted U-shape and provide a space therebetween for placement of respectively insets 32, 32' as in seen in FIGS. 4-6. As shown in FIGS. 1 and 2, insets 32, 32' do not have the width of front legs 30, 30' or rear legs 28, 28' thereby forming a recess and allowing space for the user's fingers to securely grip arms 27, 27'. Cantilevered ends 29, 29' further allow easy gripping of arms 27, 27' as shown for example in FIG. 6 as elderly user 60 grasps arm 27 during egress. As would be understood front legs 30, 30', insets 32, 32' and arms 27,27' are respectively joined together such as by conventional bolts or screws (not shown) for structural stability.

Figure 7:
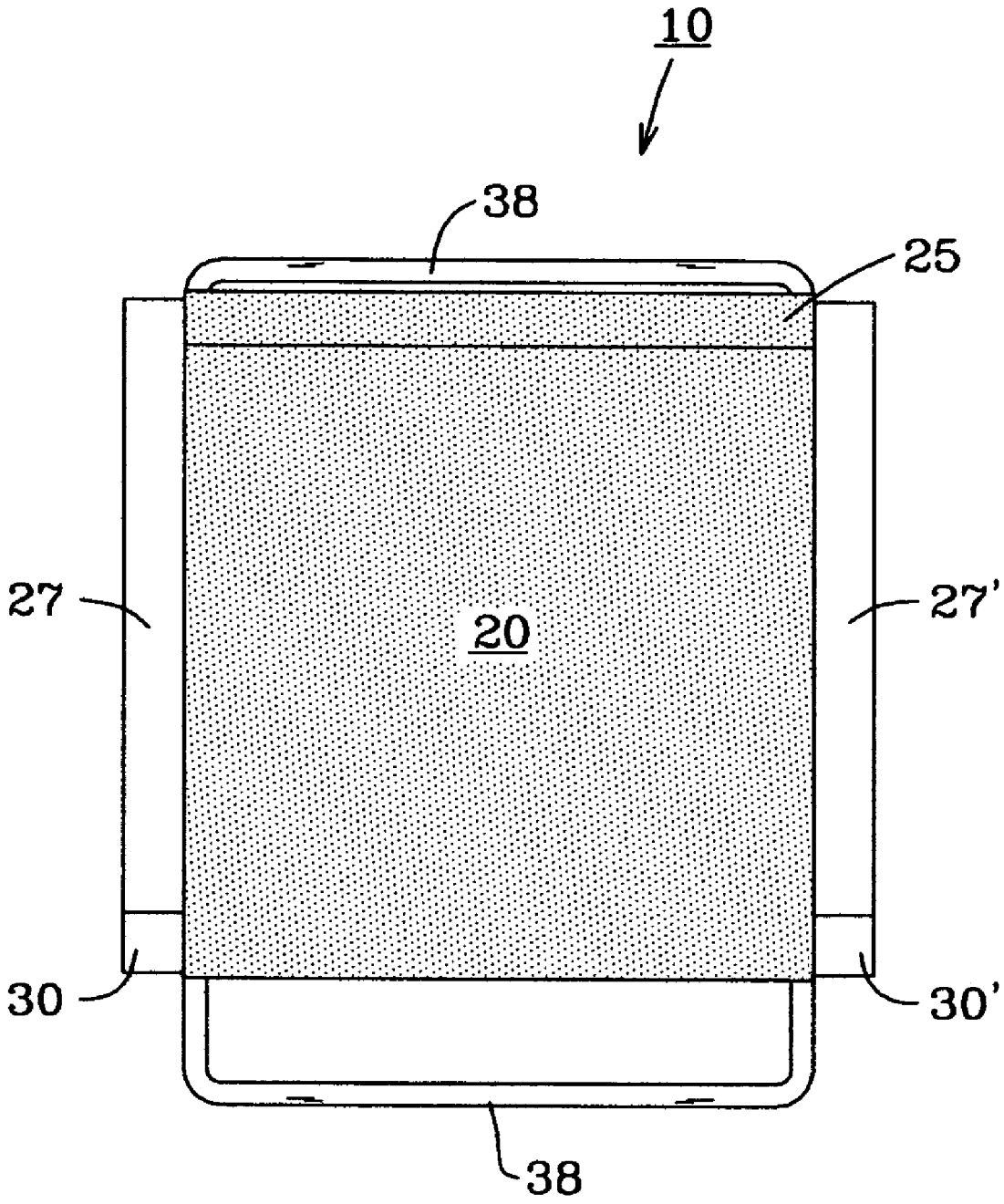
FIG. 7 illustrates a top plan view of the chair as shown in FIG. 1.

Footrest 38 as shown in FIG. 7 is likewise a rectangular shape and is longer than rectangular seat 20 to assist user 60 when mounting or departing chair 10. Footrest 38 is preferably formed from tubular steel and is affixed to front legs 30, 30' and rear legs 28, 28' by conventional screws or bolts (not shown).

When in use as shown in FIGS. 5-6, tiltable seat 20 allows for movement in a seesaw like manner. In FIG. 4, seat 20 is shown in a horizontal position whereas in FIG. 6, seat 20 is tilted or rotated along axle 16 forwardly, to allow easy ingress and egress of user 60. By utilizing cantilevered arm ends 29, 29' and footrest 38 and with the shifting weight of user 60 on seat 20 as shown in FIG. 5, seat 20 is tilted rearwardly with user 60 in a secure, rearwardly sitting position. Safety and convenience are thus afforded user 60 with seat 20 as in FIG. 5, user 60 is less likely to inadvertently slide or topple forwardly from seat 20 whereas in FIG. 6 user 60 by utilizing cantilevered ends 29, 29' and footrest 38 can more conveniently mount and depart chair 10 with tiltable seat 20.

The illustrations and examples provided herein are for explanatory purposes and are not intended to limit the scope of the appended claims.

We claim:

1. A chair for assisting users in sitting therein and exiting therefrom comprising: a frame, said frame comprising a front laterally extending member, a rear laterally extending member, a pair of side longitudinal members, said front and said rear laterally extending members joined to said pair of side longitudinal members in rectangular form, a pair of L-shaped front legs, a pair of L-shaped rear legs, said pair of L-shaped rear legs longer than said pair of L-shaped front legs, said pair of L-shaped front legs and said pair of L-shaped rear legs opposingly attached exteriorly of said frame, each of said pair of L-shaped front logs connected to different ones of said pair of L-shaped rear legs, each of said pair of L-shaped rear legs extending over different ones of said pair of L-shaped front legs above said frame to provide a pair of arms, said pair of arms each defining cantilevered ends, a seat, said seat positioned on said frame between said pair of arms, a pillow block, an axle, said pillow block rotatably mounted on said axle, said pillow block affixed to said seat, said axle joined to said frame forward of the longitudinal frame midpoint whereby said pillow block allows said seat to tilt for easy ingress and egress and said front laterally extending member limits the rotation of said seat as said cantilevered arm ends allow convenient gripping.

2. The chair of claim 1 wherein said pair of L-shaped front legs and said pair, of L-shaped rear legs comprise inverted L-shapes.

3. The chair of claim 1 further comprising a pair of insets, said pair of insets each positioned between different ones of said pair of L-shaped front legs and said pair of L-shaped roar legs to space said pair of L-shaped front legs from said pair of L-shaped rear legs.

4. The chair, of claim 1 further comprising a rectangular footrest, said footrest affixed interiorly to each of said pair of L-shaped front legs and said pair of L-shaped rear legs, said footrest extending forwardly beyond said pair of L-shaped front legs below said frame.

5. The chair of claim 4 further comprising a back, said back affixed to said pair of L-shaped rear legs and extending above said seat.

* * * * *